US010457298B2

(12) United States Patent
Karner et al.

(10) Patent No.: US 10,457,298 B2
(45) Date of Patent: Oct. 29, 2019

(54) CHASSIS FRAME WITH SPRING CUP

(71) Applicant: Siemens AG Oesterreich, Vienna (AT)

(72) Inventors: Christian Karner, Ilz (AT); Radovan Seifried, Maribor (SI)

(73) Assignee: Siemens Mobility GMBH, Vienna (AT)

( * ) Notice: Subject to any disclaimer, the term of this patent is extended or adjusted under 35 U.S.C. 154(b) by 289 days.

(21) Appl. No.: 15/512,787

(22) PCT Filed: Aug. 12, 2015

(86) PCT No.: PCT/EP2015/068527

§ 371 (c)(1),
(2) Date: Mar. 20, 2017

(87) PCT Pub. No.: WO2016/045864

PCT Pub. Date: Mar. 31, 2016

(65) Prior Publication Data

US 2017/0291618 A1 Oct. 12, 2017

(30) Foreign Application Priority Data

Sep. 22, 2014 (AT) ..... A 50665/2014

(51) Int. Cl.
*B61F 5/52* (2006.01)

(52) U.S. Cl.
CPC ..... *B61F 5/52* (2013.01)

(58) Field of Classification Search
CPC ..... B61F 5/52; B61F 5/06; B61F 5/30; B61F 5/26; B61F 5/28; B61F 5/301
See application file for complete search history.

(56) References Cited

U.S. PATENT DOCUMENTS 762,043 A * 6/1904 Gallagher ..... B61F 5/52 105/205
860,925 A * 7/1907 Lipschutz ..... B61F 5/52 105/205
1,617,811 A 2/1927 Huntoon
3,754,514 A 8/1973 Peterson
4,351,242 A 9/1982 Irwin
5,546,869 A 8/1996 Nassar
(Continued)

FOREIGN PATENT DOCUMENTS

CN 1107431 8/1995
CN 1140676 1/1997
(Continued)

*Primary Examiner* — Mark T Le
(74) *Attorney, Agent, or Firm* — Cozen O'Connor

(57) ABSTRACT

A chassis frame for a bogie of a rail vehicle which includes at least one longitudinal member having an upper chord and a lower chord, wherein the longitudinal member has at least one end portion, a central portion, and a transition portion lying between the end portion and the central portion, and the end portion of the longitudinal member is formed as a spring cup for receiving a primary spring, where in order to improve the rigidity curve between the spring cup and the transition portion the lower chord is provided with a curvature in the region of the transition portion, where the curvature is formed such that the imaginary extension of the lower chord and the upper chord itself or the imaginary extension of the upper chord intersect in the end portion.

12 Claims, 4 Drawing Sheets

(56) References Cited

U.S. PATENT DOCUMENTS

| | | | | |
|---|---|---|---|---|
| 5,653,177 | A | 8/1997 | Rimbaud et al. | |
| 6,142,081 | A | 11/2000 | Long et al. | |
| 9,469,313 | B2 * | 10/2016 | Hagio | B61F 5/52 |
| 2003/0033955 | A1 | 2/2003 | Martin | |
| 2012/0240813 | A1 | 9/2012 | Becher et al. | |

FOREIGN PATENT DOCUMENTS

| | | | | |
|---|---|---|---|---|
| CN | 101500876 | | | 8/2009 |
| CN | 201792866 | U | | 4/2011 |
| DE | 25 14 304 | A1 | | 10/1975 |
| EP | 0 646 511 | A1 | | 4/1995 |
| GB | 1 509 431 | | | 5/1978 |
| RU | 2163551 | C2 | | 2/2001 |
| RU | 2280575 | C2 | | 7/2006 |
| RU | 2434772 | C2 | | 11/2011 |
| RU | 2012101465 | | | 8/2013 |
| WO | WO 2008/070953 | A1 | | 6/2008 |
| WO | WO 2011/006927 | | | 1/2011 |
| WO | WO 2013/091319 | | * | 6/2013 |
| WO | WO 2013/175716 | | | 11/2013 |
| WO | WO 2014/131117 | A1 | | 9/2014 |

* cited by examiner

FIG 3
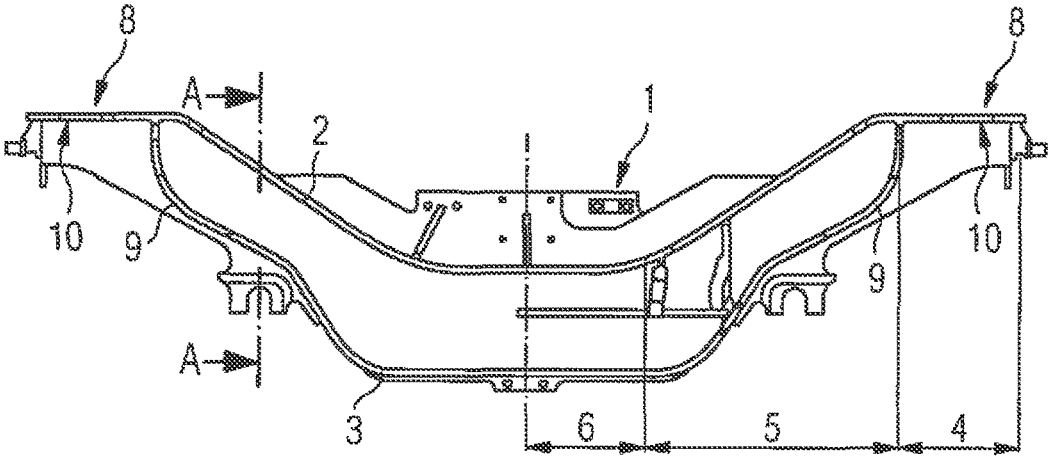
FIG 4
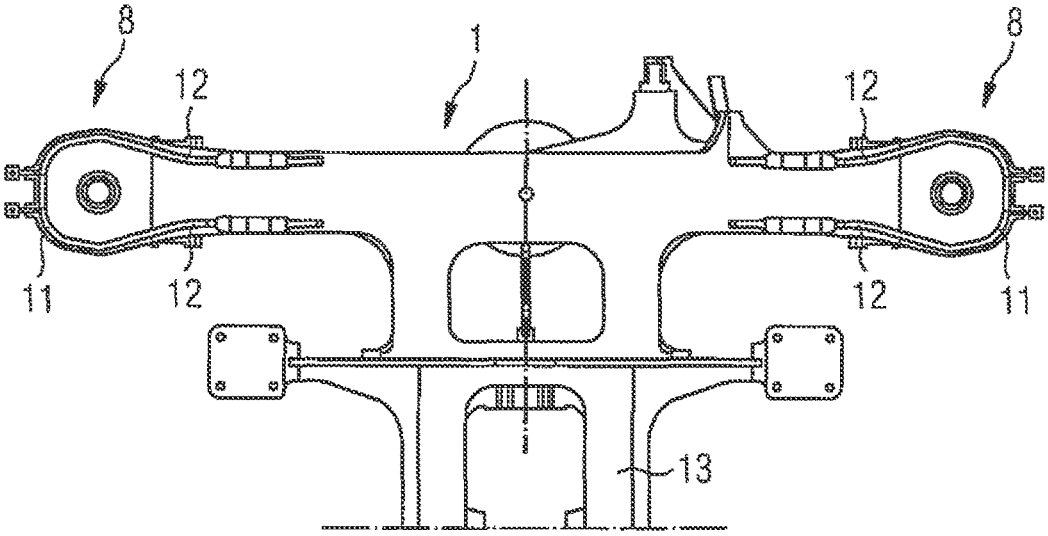
FIG 5 A-A
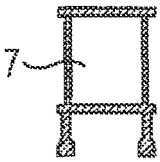

CHASSIS FRAME WITH SPRING CUP

CROSS-REFERENCE TO RELATED APPLICATIONS

This is a U.S. national stage of application No. PCT/EP2015/068527 filed 12 Aug. 2015. Priority is claimed on Austrian Application No. A50665/2014 filed 22 Sep. 2014, the content of which is incorporated herein by reference in its entirety.

BACKGROUND OF THE INVENTION

1. Field of the Invention

The invention relates to a chassis frame for a bogie of a rail vehicle, comprising at least one longitudinal member having an upper chord and a lower chord, where the longitudinal member has at least one end portion, a central portion and a transition portion lying between the end portion and the central portion, and where the end portion of the longitudinal member is formed as a spring cup for receiving a primary spring suspension.

As a general rule, the chassis frame has two longitudinal members arranged parallel to one another. Each longitudinal member generally has a central portion, to which is attached in each case on both sides a transition portion and an end portion is attached in each case to a transition portion. The invention is suitable both for bogies having straight longitudinal members, where the upper chord therefore essentially lies mostly in one plane in all portions, and also for bogies having offset longitudinal members. In the case of offset longitudinal members, the transition portion forms the offset.

2. Description of the Related Art

As a general rule, bogies for rail vehicles are employed to support motor coaches or cars and to establish a connection with the rails. A bogie therefore has as its central element a chassis frame that normally has a primary spring suspension for transmitting the forces into a wheelset in contact with the rails and also a secondary spring suspension for supporting the car or the motor coach. In this situation, the spring suspensions serve to reduce or dampen the vibrations that occur, and, enable the wheels to run quietly at different travel speeds and track characteristics such as traveling a curve or a straight section.

Chassis frames must therefore be designed such that they can withstand the high stresses and applied forces, such as weight forces or inertial forces, without plastic deformations occurring. Chassis frames therefore have high moments of resistance against bending movements and torsion. In practice, this behavior is achieved as a general rule via a welded construction that comprises a transverse member and two longitudinal members arranged at the end regions of the transverse member. Here, the longitudinal members can be designed in an offset manner, as a result of which a central portion stepped in the direction of the rails is formed, where the central portion is connected to the transverse member. A transition portion angled only in the case of offset longitudinal members) is formed in each case on both sides starting from the central portion, followed by an end portion, essentially parallel (in the case of offset longitudinal members) to the central portion or situated at the same height (in the case of straight longitudinal members), to accommodate the primary spring suspension.

In order to enable cylindrical springs, flexicoil springs or leaf springs forming the primary spring suspension to be accommodated, the end portions of the longitudinal member are formed as spring cups. A spring cup serves to center the spring and introduce forces into the spring, in which case the maximum deflection of the spring in the radial direction is limited at the same time. As a general rule, the spring cup therefore has a circular, oval or rectangular cross-section and is open in the direction of the wheelset, i.e., downward in an operating position, such that a profile having an open cross-section is formed. A particularly high degree of importance is attributed to the transition from the cross-section, such as a closed box section, of the longitudinal member in the region of the central portion and of the transition portion to the open cross-section of the spring cup because this is a highly stressed region that is further weakened by the presence of weld seams, in particular because the tensions in the weld seams must be kept as low as possible.

A disadvantage of the prior art therefore consists in the fact that elaborate measures relating to fabrication must be taken, such as the provision of access openings having covers, in order to enable weld seams to be employed in the stressed zones. A further disadvantageous solution consists in locally overdimensioning the relevant positions, as a result of which the weight and the material costs are increased.

SUMMARY OF THE INVENTION

In view of the foregoing, it is therefore an object of the invention to provide a chassis frame for a bogie of a rail vehicle, which chassis frame overcomes the disadvantages of the prior art and forms an optimized transition between the transition portion and the end portion so that the rigidity curve between the end portion forming the spring cup and the transition portion is improved. Furthermore, the invention should be characterized by a low material outlay, low production costs and an advantageous course of the weld seams.

This and other objects and advantages are achieved in accordance with the invention by a chassis frame for a bogie of a rail vehicle comprising at least one longitudinal member having an upper chord and a lower chord, where the longitudinal member has at least one end portion, a central portion and a transition portion lying between the end portion and the central portion, and where the end portion of the longitudinal member is formed as a spring cup for receiving a primary spring suspension.

In accordance with the invention, the lower chord has a curvature in the region of the transition portion formed such that an imaginary extension of the lower chord and the upper chord itself or the imaginary extension of the upper chord intersect in the end portion.

By providing a curvature, which can be formed in a circular arc, elliptical or convex form, the force flow is introduced optimally into the lower chord. Such an introduction is achieved in that the lower chord is taken in the direction of the upper chord by the curvature, whereby the lower chord can be connected at its end edge to the upper chord, in particular can be welded. Consequently, the region up to which the lower chord is taken is understood as being the transition portion. The force introduced by way of the spring cup or the force to be introduced into the spring cup is thereby also optimally introduced into the upper and lower chords in the transition between the end portion and the transition portion.

At the end facing the end portion, as a general rule, the upper chord of the longitudinal member forms a region which extends parallel to the central portion (in the case of an offset longitudinal member) or continues in level manner from the central portion by way of the transition portion to the end portion (in the case of a straight longitudinal member). Here, the extension of the lower chord, i.e., the imaginary extension of that end of the lower chord that faces away from the central portion, intersects the upper chord in precisely that parallel or level region. A weld seam by which the upper chord and lower chords are connected may, for example, be present at the intersection. The point at which the two chords intersect forms the start of the end portion. As a result, the intersection lies in precisely that end portion.

In alternative embodiments, the upper chord and the lower chord are not connected directly to one another, but a further element that extends the upper chord is arranged in the transition portion on the upper chord. Here, the extension of the lower chord, as described above, does not intersect the upper chord itself but only the imaginary extension of the upper chord. The intersection lies either at the start of the end portion should the upper chord despite everything have a parallel portion or, on the other hand, the intersection lies in a region above the end portion should the upper chord already end in the angled region of the transition portion of an offset longitudinal member. The actual connection, i.e., a welded connection, of the lower chord to the upper chord is therefore effected by way of the further element that acts in this situation as a connection element between the two chords.

In a further embodiment of the chassis frame in accordance with the invention, the end of the lower chord and the end of the upper chord enclose an angle, which angle is in a region of 60°, preferably 70°, particularly preferably 80°, up to 90°. Naturally the angle occurring likewise relates to the imaginary extensions of the ends of the chords should the lower chord not be connected directly to the upper chord. In any case, the angle relates to the acute angle that normally forms at the end of the transition portion between the upper and lower chords. Due to the junction of the lower chord at an acute angle or right angle, this results in a particularly favorable force flow and an advantageous placement of a weld seam that is arranged on the obtuse side of the angle in each case, in other words the side accessible from outside.

Very good mechanical properties, such as were required in accordance with the above-stated objects of the invention, are achieved in that the longitudinal member has a first cross-section at least in sections in the transition portion, in which case the first cross-section is designed either as a closed box cross-section that consists of an upper chord, a lower chord and the side elements connecting the two chords, which are welded together with one another, or is designed as an I-profile that consists of an upper chord, a lower chord and a crosspiece connecting the two chords.

In order to increase the length of the weld seams and to relocate the weld seam ends out of the highly stressed zones, in a preferred embodiment the chassis frame in accordance with the invention, the spring cup comprises a spring base for receiving the primary spring suspension and also a jacket for enclosing sections of the primary spring suspension, where the jacket of the spring cup has at least one continuation that contact at least in sections with a section of the lower chord having the curvature. Here, the jacket of the spring cup can be constructed from a single plate-shaped element or it can consist of a plurality of plates connected to each other, preferably welded. In this case, at least in sections, the jacket forms a cross-section that surrounds the primary spring suspension around its full circumference and restricts a movement of the primary spring suspension in a direction normal to a main spring direction.

With the continuation, which closely follows the curvature of the lower chord and therefore normally narrows in the direction of the central portion, on the one hand, the weld seam between the lower chord and the jacket of the spring cup is extended. As a result, the cross-section of the weld seam can be reduced in comparison to the prior art. On the other hand, in this case the weld seam does not end in a highly stressed region, which has a positive effect on the strength behavior. The continuation has a similarly positive effect as a stiffening element on the moment of resistance of the longitudinal member against bending.

In accordance with a further preferred embodiment, the lower chord forms the jacket of the spring cup at least in sections. In particular, the portion of the lower chord having the curvature is suitable for forming a side surface of the jacket. This results, on the one hand, in a saving in material and, on the other hand, in a reduction in weld seams, which has the effect of reducing production costs.

It is known that tensile stresses that can stress the weld seam between continuation and lower chord may occur in the operating state in the lower chord in the region of the curvature. Consequently, in a further preferred embodiment the continuation of the spring cup makes contact with the lower chord (additionally or alternatively) in a non-curved section, which section faces the central portion of the longitudinal member. The continuation is thereby extended beyond the curvature. In the contact region, the continuation is connected directly to the lower chord and/or to a further element of the chassis frame, such as a wheelset guide, preferably welded.

In a further embodiment, the upper chord forms the spring base to achieve a particularly simple design and to simplfy production.

In a particularly preferred embodiment of the chassis frame in accordance with the invention, the spring base is a plate-shaped element that is connected at least to the upper chord. As a result of the formation of the spring plate using a separate plate-shaped element, the element can exhibit a greater strength than the upper chord or the lower chord in order to be capable of sustaining a high load. This means that the upper chord or lower chord itself, which have a lower loading, because the loading is distributed over the two chords, can have a thinner wall thickness, thereby reducing the weight of the chassis frame in total.

In a further particularly advantageous embodiment, the spring base has a fork-like connection section for connection to the upper chord and the lower chord. In order to introduce the forces absorbed by the spring base evenly into the upper and lower chords without needing to provide the highly stressed transition between spring base directly with a weld seam in this situation, the fork-like connection section is formed such that at least one fork-like continuation projects beyond the upper chord and makes contact with the upper chord at least in sections to connect the spring base to the upper chord, preferably a welded connection, and also least one further fork-like continuation projects beyond the lower chord and makes contact with the lower chord in the region of the transition portion at least in sections, in order to connect the spring base to the lower chord, preferably a welded connection.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

For further explanation of the invention, reference is made to the figures in the following part of the description from which further advantageous embodiments, details and developments of the invention can be derived. The figures are to be understood as exemplary and although they should demonstrate the character of the invention they should not under any circumstances restrict or even definitively represent the character in which:

FIG. 3 shows a side view of an embodiment of a chassis frame in accordance with the invention;

FIG. 4 shows a view of the underside of a chassis frame in accordance with the invention;

FIG. 5 shows a cross-section through a longitudinal member of a chassis frame in accordance with the invention along line AA from FIG. 3;

DETAILED DESCRIPTION OF THE EXEMPLARY EMBODIMENTS

Figure 1:
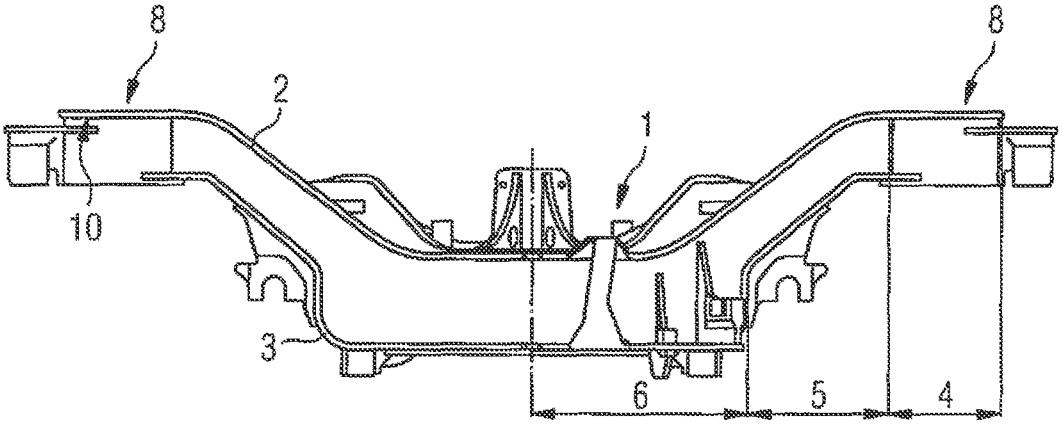
FIG. 1 shows a side view of a chassis frame in accordance with the prior art.
Figure 2:
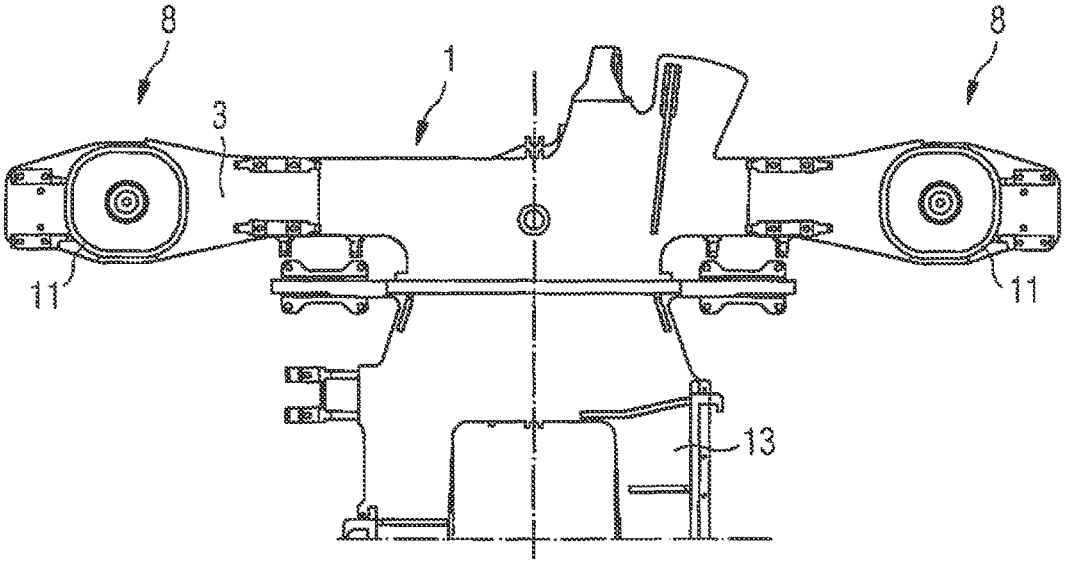
FIG. 2 shows a view of the underside of a chassis frame in accordance with the prior art.

FIGS. 1 and 2 show an offset longitudinal member 1 of a chassis frame for a bogie in accordance with the prior art with an upper chord 2 and a lower chord 3. Here, the longitudinal member 1 has a central portion 6 stepped downward in the operating state, on which a transverse member 13 is arranged. Starting from the central portion 6, two transition portions 5 angled with respect to the central portion are formed, each of which ends in an end portion 4, which end portions 4 extend essentially parallel to the central portion 6. Consequently, only one side of the longitudinal member 1 will be described in detail, where the statements naturally also apply to the other side.

Upper chord 2 and lower chord 3 extend approximately parallel in the central portion 6, over a large part of the transition portion 5 and in the end portion 4, and are connected to one another via side walls (not illustrated) to form a closed first (here box-shaped) cross-section 7 (see FIG. 5). In this situation, the end portion 4 forms a spring cup 8 that serves to receive a primary spring suspension, such as a cylindrical spring, a Flexicoil spring or a leaf spring, of the bogie. Here, the spring cup 8 comprises a spring base 10 upon which the primary spring suspension bears and via which spring base 10 the primary spring suspension is centered. In addition, the spring cup 8 also comprises a jacket 11 that surrounds the primary spring suspension in the region of the end portion 4 of the longitudinal member 1.

In order to enable the primary spring suspension to be received in the spring cup 8, the lower chord 3 is taken only as far as the jacket 11 of the spring cup 8 in the end portion 4 and surrounds the jacket 11 at least along a section of the jacket surface. In other embodiments, the lower chord 3 is formed as a support for the jacket 11 and reaches under said jacket 11 at least in sections, where in this case the lower chord 3 has an opening, through which the primary spring suspension enters the spring cup 8. There are a plurality of further embodiments that will not be discussed here because they all encounter the same problem:

In the transition region to the spring cup 8 the cross-section switches from the closed box-shaped cross-section 7 (see, e.g. FIG. 5) to an open cross-section, which is due to receiving the primary spring suspension. This causes the occurrence of an abrupt and unfavorable change in the rigidity curve of the longitudinal member 1, in which case the placement of weld seams for connecting the spring cup 8 or the jacket 11 thereof to the upper chord 2 or lower chord 3 also has a negative influence on the curve. The ends of the weld seams constitute particularly vulnerable zones and in the exemplary embodiment described lie in the highly stressed section between spring cup 8 and the transition portion 5 of the longitudinal member 1.

FIG. 2 shows an alternative view of the embodiment described above of a chassis frame in accordance with the prior art, where the side of the chassis frame receiving the primary spring suspension is illustrated. In particular, the transverse member 13 connected to the central portion 6 of the longitudinal member 1 can be seen here. It can likewise be seen from this figure that the jacket 11 of the spring cup 8 has a rectangular cross-section that is rounded at the corners, and that the jacket 11 is partially enclosed by the lower chord 3.

FIGS. 3 to 6 now relate to an embodiment of a chassis frame in accordance with the invention. The longitudinal member 1 likewise has a central portion 6, two end portions 4 and two transition portions 5 and is connected in the central portion 6 to a transverse member 13. The differences with regard to the definition of the portions will be described in the following.

It can be clearly seen in FIG. 3 that in accordance with the invention, the lower chord 3 has a curvature 9 that is formed such that the lower chord 3 closes the box-shaped cross-section 7 in the transition portion 5 in that the lower chord 3 is curved in the direction of the upper chord 2. Here, the radius of curvature or the radius of an osculating curve is chosen to be as large as structurally possible in order to obtain favorable stress conditions. In the exemplary embodiment, the lower chord 3 and thus naturally also an imaginary extension of the lower chord 3 intersect the upper chord 2 directly, whereby an angle of 90° is enclosed between the upper chord 2 and the extension of the lower chord 3. At the closing end of the upper chord 2 and of the lower chord 3 a weld seam is provided that connects upper chord 2 and lower chord 3. The boundary between the transition portion 5 of the longitudinal member 1 and the end portion 4 lies at that location at which upper chord 2 and lower chord 3 intersect, where the interface itself is attributed both to the transition portion 5 and also to the end portion 4.

Such a configuration offers a plurality of advantages. On the one hand, when viewed in the direction of the transverse member 13, upper chord 2 and lower chord 3 form a continuous closed profile that enables an optimized rigidity curve. On the other hand, the force acting on the longitudinal member 1 is distributed directly to upper chord 2 and lower chord 3.

A further aspect of the invention relates to the formation of the spring cup 8 which, in conjunction with the aforementioned, results in particularly advantageous synergies. The jacket 11 of the spring cup has, at each side, a continuation 12 that engages around the lower chord 3, in other words makes contact with the lower chord in that region exhibiting the curvature 9. Here, as a general rule, the continuation 12 is in each case connected to the lower chord 3 close to or at the longitudinal edge of the lower chord 3. This means that a weld seam, which connects the spring cup 8 to the lower chord 3, can be made considerably longer, which means that the thickness of the weld seam can be reduced and in particular one end of the weld seam can be arranged in a less stressed section of the lower chord 3 that lies closer to the central portion 6. In this case, the continuations 12 are taken right into a section behind the curvature 9, in which the lower chord 3 is essentially rectilinear. Here, the jacket 11 can be produced from one piece, or can be constructed from a plurality of plate members connected to one another, preferably welded. A width of the continuation, in other words that dimension that specifies the distance of the outer edge of the continuation 12 to the edge making contact with the lower chord 3 is at least 100 to 150 mm in this situation, where widths greater than 150 mm are generally to be preferred, if this is permitted by other assemblies of the chassis frame.

In order to route the primary spring suspension, it is necessary for the primary spring suspension to be surrounded around its full circumference by the jacket 11. In the exemplary embodiment described, in the section exhibiting the curvature 9 and connected to the upper chord 2 the lower chord 3 forms a part of the jacket surface 11, more precisely the side surface of the jacket 11 facing the transverse member 13.

The spring base 10 of the spring cup 8 is formed by the upper chord 2. In alternative embodiments, the spring base 10 is however a separate component which is connected to the upper chord 2, preferably welded. This means that the spring base 10 can, in a simple manner, have a greater thickness than the upper chord 2 itself. In order to enable an optimum connection to a lower chord 3 curved in accordance with the invention, the spring base 10 can, in this situation, have a fork-like connection section, where at least one of the forks is connected to the lower chord 3 and at least one of the forks is connected to the upper chord 2 so that the weld seams do not run directly in the region of the interface of upper chord 2 and lower chord 3.

The configuration in accordance with the invention of the jacket 11 of the spring cup 8 having the continuations on both sides can be clearly seen from FIG. 4.

Figure 6:
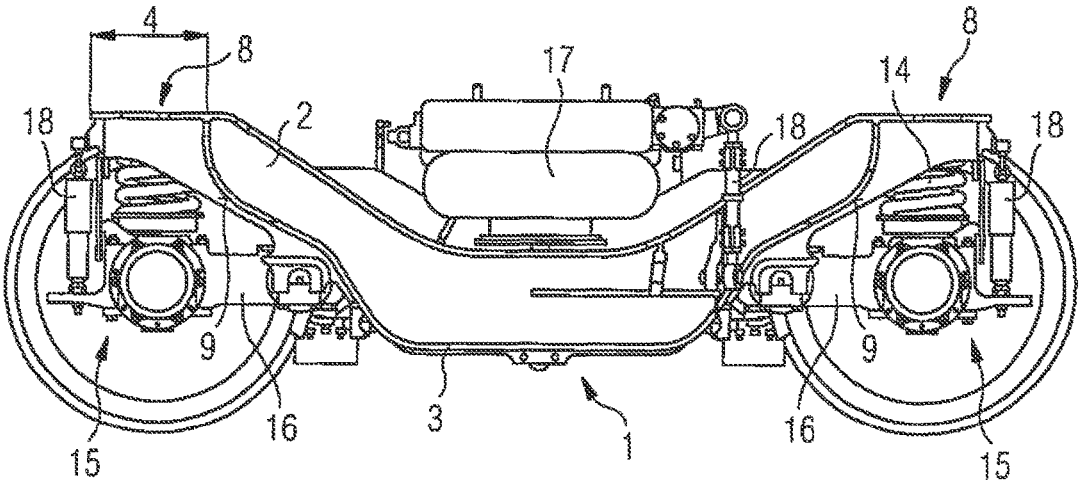
FIG. 6 shows an illustration of a bogie having a chassis frame in accordance with the invention.

FIG. 6 shows a chassis frame in accordance with the invention in a bogie. In this case, in particular, primary springs 14 are inserted into the spring cups 8 that are connected at that end situated opposite the spring base 10 to a wheelset 15. At the same time, the wheelset 15 is attached via a wheelset guide 16 to the chassis frame. The continuations 12 of the jacket 11 are taken as far as the part of the wheelset guide 16 attached to the chassis frame and are connected to that part, preferably welded. A secondary spring 17 is arranged centrally in the central portion 6 of the longitudinal member 1. In addition to the springs, damper elements 18 are also arranged on each of the springs 14,17.

Figure 7:
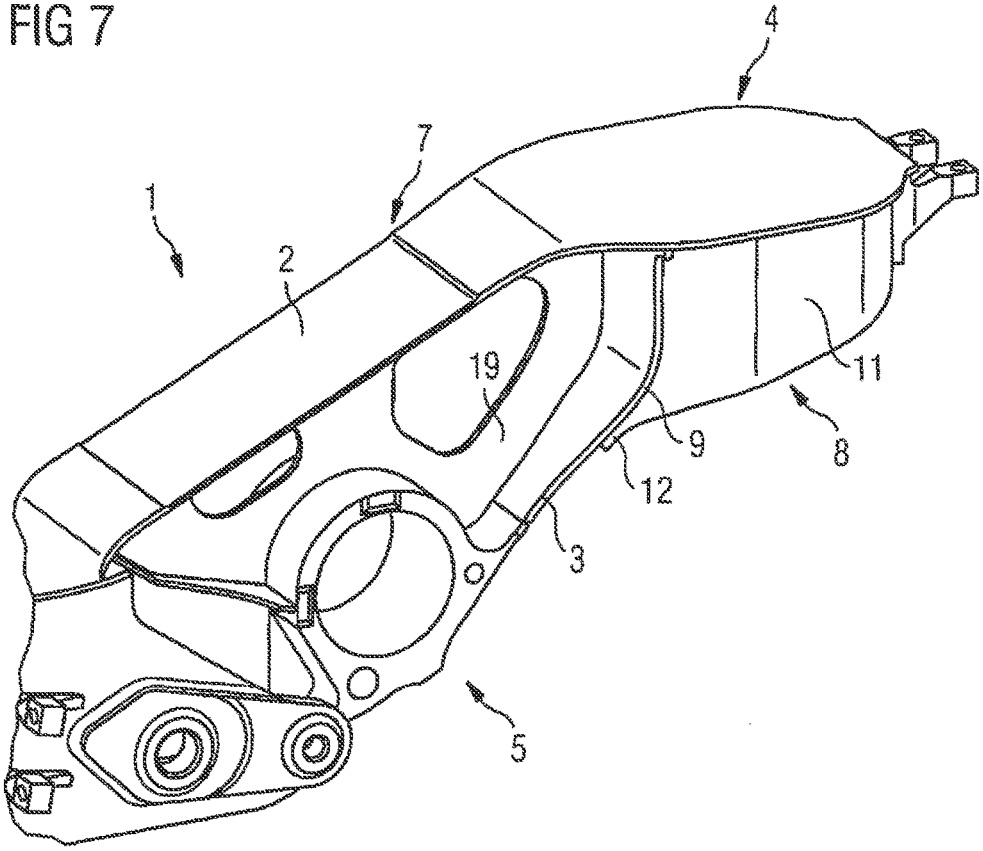
FIG. 7 shows an axonometric view of an alternative embodiment of a chassis frame in accordance with the invention.
Figure 8:
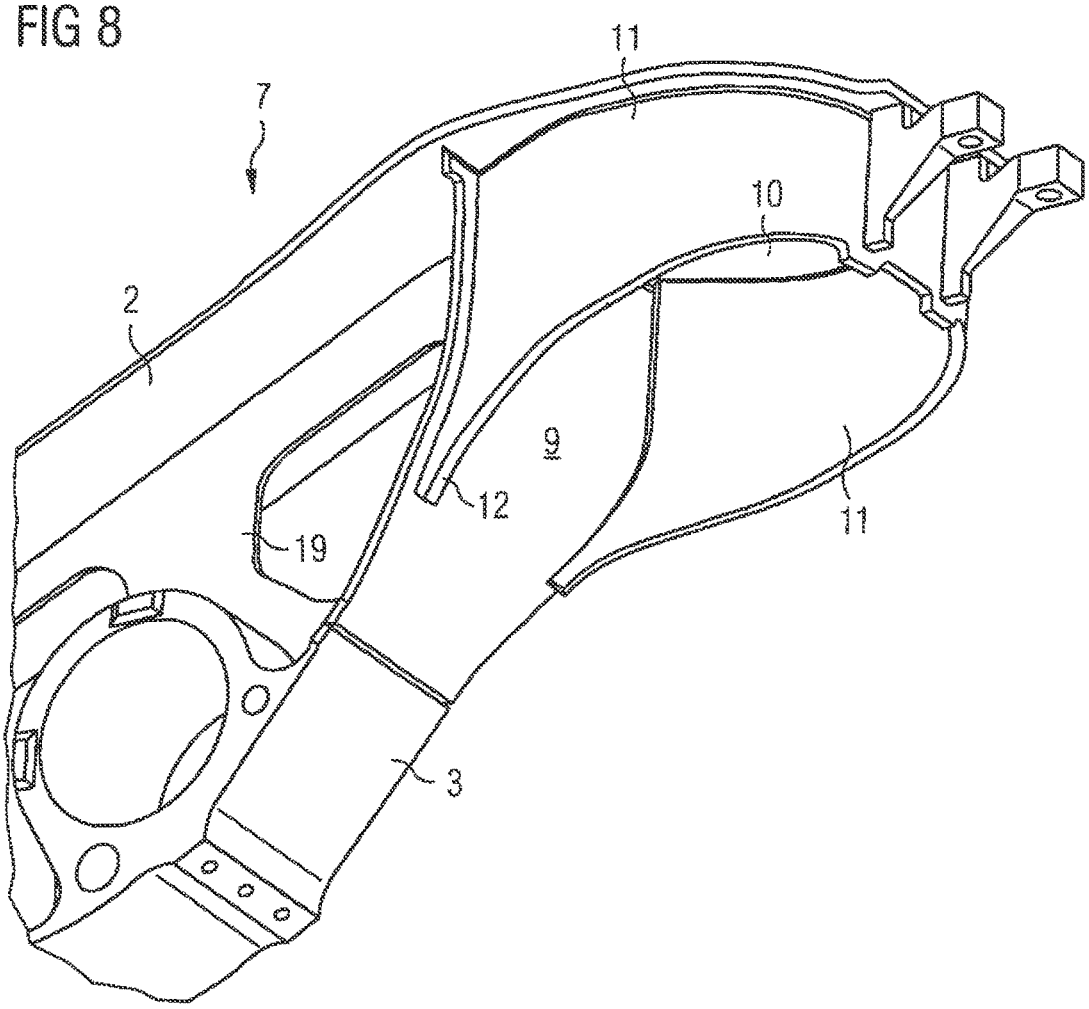
FIG. 8 shows a further axonometric view of an alternative embodiment of a chassis frame in accordance with the invention.

FIGS. 7 and 8 show a three-dimensional illustration of an alternative embodiment of a longitudinal member 1 in accordance with the invention, in particular of the transition portion 5 and of the end portion 4. In contrast to the first exemplary embodiment, the first cross-section 7 in the present embodiment is formed as an I-profile, where the upper chord 2 and the lower chord 3 are connected by a crosspiece 19. The spring cup 8 itself can likewise be easily recognized, together with its jacket 11 and the continuation 12 that engages around the curvature 9 in sections. In particular, FIG. 8 shows the spring cup 8 clearly, so that it can be clearly seen where the primary spring 14 is arranged in a bogie.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those element steps which perform substantially the same function in substantially the same way to achieve the same results are within the scope of the invention. Moreover, it should be recognized that structures and/or elements shown described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A chassis frame for a bogie of a rail vehicle, comprising:

at least one longitudinal member having an upper chord, a lower chord, at least one end portion, a central portion, and a transition portion lying between the end portion and the central portion, said end portion of the longitudinal member being formed as a spring cup for receiving a primary spring suspension;

wherein the lower chord has a curvature in a region of the transition portion, which is configured such that an imaginary extension of the lower chord and the upper chord itself or an imaginary extension of the upper chord intersect in the end portion;

wherein the spring cup comprises (i) a spring base for receiving the primary spring suspension and (ii) a jacket for enclosing sections of the primary spring suspension;

wherein the jacket of the spring cup has at least one continuation which contacts at least in sections with a section of the lower chord having the curvature;

wherein the at least one continuation of the spring cup contacts the lower chord in a non-curved section which faces the central portion of the longitudinal member.

2. The chassis frame as claimed in claim 1, wherein an end of the lower chord and an end of the upper chord enclose an angle which is in a region of 60° up to 90°.

3. The chassis frame as claimed in claim 1, wherein the longitudinal member has a first cross-section which is box-shaped at least in sections in the transition portion.

4. The chassis frame as claimed in claim 2, wherein the longitudinal member has a first cross-section which is box-shaped at least in sections in the transition portion.

5. The chassis frame as claimed in claim 1, wherein the longitudinal member has a first cross-section formed as an I-profile at least in sections in the transition portion.

6. The chassis frame as claimed in claim 2, wherein the longitudinal member has a first cross-section formed as an I-profile at least in sections in the transition portion.

7. The chassis frame as claimed in claim 1, wherein the lower chord forms the jacket of the spring cup at least in sections.

8. The chassis frame as claimed in claim 1, wherein the upper chord forms the spring base.

9. The chassis frame as claimed in claim 1, wherein the spring base is a plate-shaped element which is connected at least to the upper chord.

10. The chassis frame as claimed in claim 9, wherein the spring base has a forked connection section for connection to the upper chord and the lower chord.

11. The chassis frame as claimed in claim 2, wherein the angle is in a region of 70° up to 90°.

12. The chassis frame as claimed in claim 11, wherein the angle is in a region of 80° up to 90°.

* * * * *